US008740348B2

(12) United States Patent
Tanaka

(10) Patent No.: US 8,740,348 B2
(45) Date of Patent: Jun. 3, 2014

(54) LIQUID COLLECTION RECEPTACLE AND LIQUID EJECTING APPARATUS

(75) Inventor: Takeshi Tanaka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 106 days.

(21) Appl. No.: 13/236,006

(22) Filed: Sep. 19, 2011

(65) Prior Publication Data

US 2012/0069086 A1 Mar. 22, 2012

(30) Foreign Application Priority Data

Sep. 21, 2010 (JP) ..... 2010-210514
Jun. 20, 2011 (JP) ..... 2011-136009

(51) Int. Cl.
*B41J 2/165* (2006.01)
*B41J 2/17* (2006.01)

(52) U.S. Cl.
CPC ..... *B41J 2/1721* (2013.01); *B41J 2/16523* (2013.01); *B41J 2002/1728* (2013.01)
USPC ..... 347/36; 347/30

(58) Field of Classification Search
USPC ..... 347/36
See application file for complete search history.

(56) References Cited

U.S. PATENT DOCUMENTS 6,203,137 B1 * 3/2001 Niimura et al. ..... 347/36
6,263,591 B1 * 7/2001 La Porte ..... 34/622
7,524,019 B2 * 4/2009 Fukasawa et al. ..... 347/36
2002/0085060 A1 * 7/2002 Usui et al. ..... 347/30
2007/0252864 A1 11/2007 Uchino
2008/0006334 A1 * 1/2008 Davidson et al. ..... 347/32
2008/0100679 A1 * 5/2008 Tyvoll et al. ..... 347/85
2008/0236480 A1 * 10/2008 Furukawa et al. ..... 118/50
2009/0231388 A1 * 9/2009 Osumi et al. ..... 347/36
2009/0315943 A1 * 12/2009 Ohnishi et al. ..... 347/36
2010/0007695 A1 * 1/2010 Miyazawa ..... 347/30
2010/0283815 A1 * 11/2010 Watanabe ..... 347/30

FOREIGN PATENT DOCUMENTS

JP 11249445 A * 9/1999
JP 2001105626 A * 4/2001
JP 2007-296757 11/2007
JP 2009061644 A * 3/2009
JP 2010184503 A * 8/2010

OTHER PUBLICATIONS

Machine generated English translation of JP2010-184503A to Hara Kazuhiko, "Inkjet Recorder"; generated via http://www.ipdl.inpit.go.jp/homepg_e.ipdl on Sep. 30, 2013; 9 pp.*

* cited by examiner

*Primary Examiner* — Shelby Fidler
(74) *Attorney, Agent, or Firm* — Workman Nydegger

(57) ABSTRACT

A waste ink tank capable of collecting discharged ink includes: an ink absorption member having a receiving area that receives the discharged ink and causes the ink to be absorbed; a recess that causes a suction force to act within the ink absorption member; and a recess, disposed in a position that is closer to the receiving area than the aforementioned recess, that causes a pressurizing force to act within the ink absorption member.

10 Claims, 7 Drawing Sheets

LIQUID COLLECTION RECEPTACLE AND LIQUID EJECTING APPARATUS

BACKGROUND

1. Technical Field

The present invention relates to liquid collection receptacles capable of receiving a liquid and liquid ejecting apparatuses provided with such liquid collection receptacles.

2. Related Art

Thus far, ink jet printers (called simply "printers" hereinafter) have been widely known as liquid ejecting apparatuses that eject a liquid onto a target through nozzle openings formed in a liquid ejecting head. With such printers, what is known as "cleaning", in which thickened ink is forcefully sucked and discharged from within a recording head (liquid ejecting head) as waste ink (liquid), is normally carried out in order to suppress the nozzle openings from being clogged by the thickened ink (liquid), to discharge bubbles, foreign objects, and so on that have become intermixed with the ink inside of the recording head, and so on (for example, see JP-A-2007-296757).

With the printer disclosed in JP-A-2007-296757, a waste ink tank is provided within the printer in a removable state. Waste ink that has been forcefully sucked from the recording head through the cleaning is discharged to the waste ink tank (liquid collector), which is disposed in a predetermined location within the printer, via a flexible tube functioning as a liquid flow channel, and is absorbed by a waste ink absorption member (liquid absorption member) held within the waste ink tank.

With the printer disclosed in JP-A-2007-296757, the waste ink absorption member held within the waste ink tank absorbs the waste ink. Due to the force of gravity, the waste ink that has been absorbed by the waste ink absorption member permeates downward in the waste ink absorption member with ease, but has difficulty permeating in the horizontal direction from the discharge location, permeating upward, and so on. Accordingly, the waste ink becomes localized in the lower area of the waste ink absorption member, which makes it difficult to disperse the waste ink throughout the entirety of the waste ink absorption member; there has thus been a risk that the waste ink absorption member will become unable to sufficiently absorb the waste ink.

SUMMARY

An advantage of some aspects of the invention is to provide a liquid collection receptacle capable of sufficiently collecting a liquid and a liquid ejecting apparatus provided with such a liquid collection receptacle.

A liquid collection receptacle according to an aspect of the invention is capable of collecting a discharged liquid, and includes: a liquid absorption member having a receiving area that receives the discharged liquid and causes the liquid to be absorbed; a suction action portion that causes a suction force to act within the liquid absorption member; and a pressurizing action portion, disposed in a position that is closer to the receiving area than the suction action portion, that causes a pressurizing force to act within the liquid absorption member.

According to this configuration, when the pressurizing action portion causes the pressurizing force to act on the liquid absorption member, the suction action portion is assisted in dispersing the liquid in the receiving area. As a result, the area of the liquid absorption member throughout which the liquid permeates and disperses is enlarged, and thus the liquid absorption member can sufficiently absorb the liquid.

In a liquid collection receptacle according to another aspect of the invention, it is preferable that the pressurizing force assist the liquid in permeating in a direction toward the suction action portion.

According to this configuration, when the pressurizing force is caused to act within the liquid absorption member, the liquid disperses toward the suction action portion, and thus the suction action portion can be assisted in dispersing the liquid at the receiving area.

In a liquid collection receptacle according to another aspect of the invention, it is preferable that the suction action portion and the pressurizing action portion be provided in positions that are distanced from each other in the horizontal direction of the liquid absorption member.

The effects of the suction force by the suction action portion are weaker farther from the suction action portion and stronger closer to the suction action portion. However, the effects of the pressurizing force by the pressurizing action portion are stronger closer to the pressurizing action portion and weaker farther from the pressurizing action portion. According to this configuration, a strong pressurizing force acts on the liquid that is far from the suction action portion and thus upon which the suction force acts with difficulty, whereas a weak pressurizing force acts upon the liquid that is near the suction action portion and thus upon which the suction force acts with ease; accordingly, the liquid can be caused to permeate throughout the entirety of the liquid absorption member.

In a liquid collection receptacle according to another aspect of the invention, it is preferable that the height of the suction action portion in the vertical direction be greater than or equal to the height of the pressurizing action portion in the vertical direction.

It is more difficult for the liquid to disperse upward than it is for the liquid to disperse downward, horizontally, and so on. However, according to this configuration, the suction force from the suction action portion acts in the upward direction on the liquid received in the receiving area, and therefore the liquid disperses upward within the liquid absorption member. As a result, the area of the liquid absorption member that receives the liquid is enlarged, and thus the liquid absorption member can sufficiently absorb the liquid.

In a liquid collection receptacle according to another aspect of the invention, it is preferable that the suction action portion and the pressurizing action portion be provided in respective side surfaces on both sides in the horizontal direction of the liquid absorption member.

It is more difficult for the liquid to disperse horizontally than it is for the liquid to disperse downward. However, according to this configuration, the suction force from the suction action portion acts in the horizontal direction on the liquid received in the receiving area, and therefore the liquid disperses in the horizontal direction within the liquid absorption member. As a result, the area of the liquid absorption member that receives the liquid is enlarged, and thus the liquid absorption member can sufficiently absorb the liquid.

In a liquid collection receptacle according to another aspect of the invention, it is preferable that the pressurizing action portion causes the pressurizing force to act from below the receiving area, and the suction action portion cause the suction force to act in the horizontal direction relative to the receiving area, at a position that is higher than the pressurizing action portion.

According to this configuration, when the pressurizing action portion causes a pressurizing force to act from below the receiving area, the liquid received in the receiving area disperses upward. Then, when the suction action portion causes a suction force to act on this dispersed liquid in the horizontal direction, the liquid disperses in the horizontal direction. As a result, the area of the liquid absorption member throughout which the liquid permeates and disperses is enlarged, and thus the liquid absorption member can sufficiently absorb the liquid.

In a liquid collection receptacle according to another aspect of the invention, it is preferable that the pressurizing action portion cause the pressurizing force to act on the receiving area in an area that is toward the opposite side as the suction action portion.

According to this configuration, when the pressurizing action portion causes a pressurizing force to act on the receiving area from below, the liquid disperses upward from an area in the receiving area that is toward the opposite side as the suction action portion. Then, when the suction action portion causes a suction force to act on this dispersed liquid in the horizontal direction, the area of the liquid absorption member throughout which the liquid permeates and disperses is enlarged across a wide range between the pressurizing action portion and the suction action portion. Accordingly, the liquid absorption member can sufficiently absorb the liquid.

A liquid ejecting apparatus according to another aspect of the invention includes: a liquid ejecting head that ejects a liquid onto a target; a liquid collection receptacle configured as described above; a discharge unit that sucks the liquid from the liquid ejecting head and discharges the liquid to the liquid collection receptacle; a suction unit that exerts a suction force on the liquid collection receptacle; and a pressurizing unit that exerts a pressurizing force on the liquid collection receptacle.

According to this configuration, the same effects as those of the aforementioned liquid collection receptacle can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of an ink jet printer, serving as a type of a liquid ejecting apparatus provided with a liquid collection receptacle in a removable state according to the invention, will be described based on the drawings. Note that in the following descriptions, the terms "depth direction," "vertical direction," and "horizontal direction" are assumed to refer to the "front," "top," and "right," respectively, indicated by the arrows shown in FIG. 1, unless otherwise specified.

Figure 1:
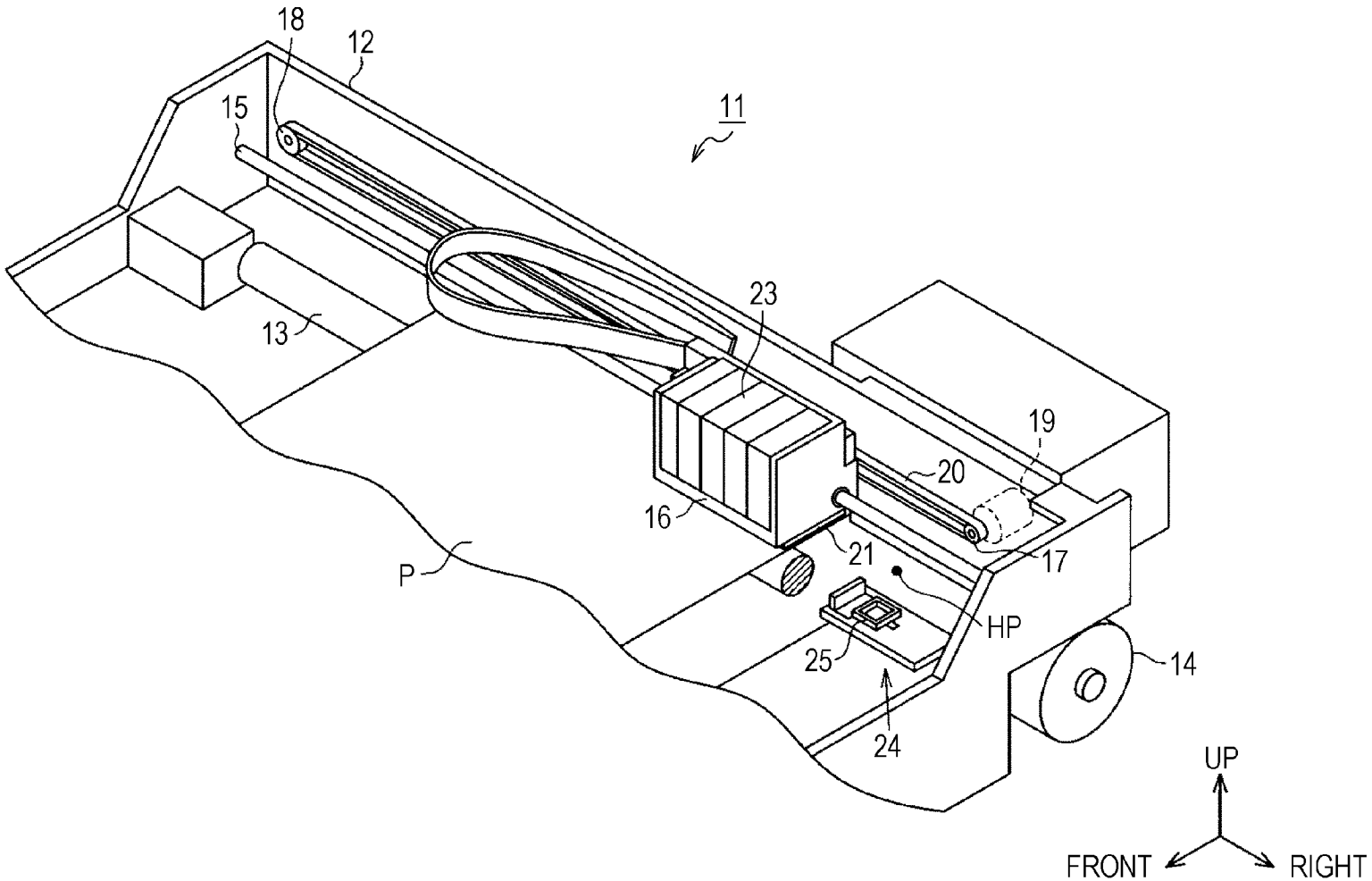
FIG. 1 is a partial cutaway cross-sectional view of a printer according to a first embodiment.

As shown in FIG. 1, an ink jet printer (called simply a "printer" hereinafter) 11 serving as a liquid ejecting apparatus according to this embodiment is provided with a frame 12, which has a rectangular shape when viewed from above. A support platform 13 extends in the horizontal direction within the frame 12, and recording paper P is fed from the back to the front along the top of the support platform 13 by a paper feed mechanism that includes a paper feed motor 14. Furthermore, a guide shaft 15 is provided above the support platform 13 within the frame 12 extending parallel to the lengthwise direction (the horizontal direction) of the support platform 13.

A carriage 16 is supported by the guide shaft 15 so as to be capable of back-and-forth movement along the axial direction (the horizontal direction) of the guide shaft 15. In addition, a driving pulley 17 and a slave pulley 18 are supported on the back surface of the frame 12 in a rotatable state in locations corresponding to the respective ends of the guide shaft 15. A carriage motor 19 that serves as a driving source when moving the carriage 16 back and forth is connected to the driving pulley 17, and a timing belt 20 to which the carriage 16 is anchored is stretched upon this pair of pulleys 17 and 18. Accordingly, due to the driving of the carriage motor 19, the carriage 16 moves in the horizontal direction via the timing belt 20 while being guided by the guide shaft 15.

As shown in FIG. 1, a recording head 21, serving as a liquid ejecting head, is provided on the bottom surface of the carriage 16. Meanwhile, a plurality of (in this embodiment, five) ink cartridges 23, for supplying ink, which is an example of a liquid, to the recording head 21, is installed in the top of the carriage 16 in a removable state. These ink cartridges 23 correspond individually to a plurality of nozzle opening rows (not shown) formed in a nozzle formation surface 21*a* (see FIG. 2) that is configured in the bottom surface of the recording head 21, and supply ink to the individual corresponding nozzle rows via ink flow channels (not shown) formed in the recording head 21.

Furthermore, a home position HP, which serves as a maintenance position at which the carriage 16 is positioned when the printer 11 is turned off, maintenance is being performed on the recording head 21, and so on, is provided at one end within the frame 12 (in FIG. 1, the right end), or in other words, at a non-printing region into which the recording paper P does not extend. A maintenance unit 24 that carries out various types of maintenance operations so as to ensure that the ink ejection from the recording head 21 onto the recording paper P is in a favorable state is provided in a location that is below the home position HP.

The maintenance unit 24 includes: a cap 25 that serves as a liquid receiving portion into which waste ink is discharged through the nozzles of the recording head 21; a discharge tube 26 that is connected to the cap 25; a suction pump 27 that sucks the contents of the cap 25 through the discharge tube 26; and a raising/lowering device (not shown) for raising/lowering the cap 25. When the cap 25 has been raised based on the driving of the raising/lowering device while the carriage 16 has been moved to the home position HP, the cap 25 makes contact with the nozzle formation surface 21*a*, which is the lower surface of the recording head 21, in a state in which the nozzle rows are surrounded by the cap 25. Meanwhile, when the suction pump 27 is driven in a state in which the cap 25 is in contact with the nozzle formation surface 21*a* of the recording head 21, negative pressure builds up within the cap 25, sucking ink from within the nozzles in the recording head 21; this ink is collected in a waste ink tank 28 serving as a liquid collection receptacle. In this embodiment, the cap 25, the discharge tube 26, and the suction pump 27 are collectively referred to as a "discharge unit."

Figure 2A:
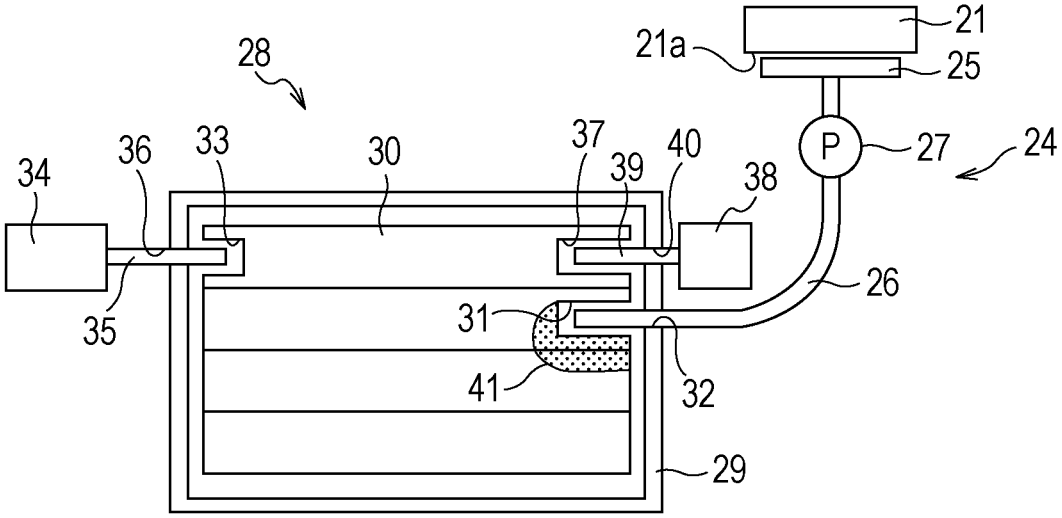
FIG. 2A is a schematic diagram illustrating a maintenance unit according to the first embodiment seen from the front.
Figure 2B:
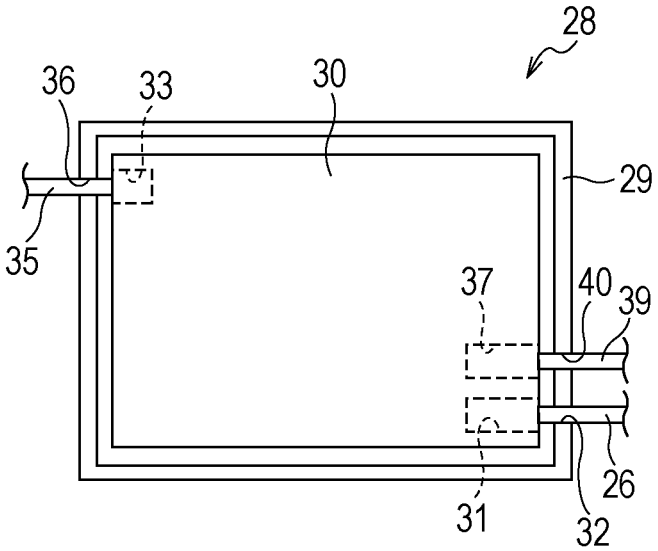
FIG. 2B is a schematic diagram illustrating the maintenance unit according to the first embodiment seen from above.

As shown in FIG. 2A and FIG. 2B, the waste ink tank 28 includes a main tank unit 29 that has a generally box-like shape; four flat ink absorption members 30 configured of a porous material, serving as liquid absorption members, are stacked in the vertical direction within the main tank unit 29. Of these ink absorption members 30, the ink absorption member 30 that is positioned second from the top has a recess 31 formed in the side surface thereof. The downstream end of the discharge tube 26 is inserted into the recess 31 of the ink absorption member 30 via a through-hole 32 formed in the side surface of the main tank unit 29. Ink discharged from the downstream end of the discharge tube 26 is thus discharged into the recess 31.

Note that of the ink absorption members 30 held within the main tank unit 29, the ink absorption member 30 in the uppermost position has a recess 33 formed in the side surface thereof that is on the opposite side as the side surface in which the recess 31 is formed. When the ink absorption members 30 are viewed from above, the recess 33 and the recess 31 are located on opposing corners of the ink absorption members 30. The leading end of a depressurizing tube 35 that extends from a depressurizing pump 34 is inserted into the recess 33 via a through-hole 36 formed in the side surface of the main tank unit 29. When the depressurizing pump 34 is driven, air is sucked out from the ink absorption members 30 within the main tank unit 29 through the depressurizing tube 35. In other words, in this embodiment, the recess 33 of the ink absorption member 30 functions as a suction action portion that causes a suction force to act on the ink absorption members 30. Note that the depressurizing pump 34 and the depressurizing tube 35 correspond to a suction unit, whereas the through-hole 36 functions as a connection portion that connects the suction unit to the main tank unit 29.

In the ink absorption member 30 in which the recess 33 is formed, a recess 37 is formed in the side surface that is on the opposite side as the side surface in which the recess 33 is formed. The leading end of a pressurizing tube 39 that extends from a pressurizing pump 38 is inserted into the recess 37 via a through-hole 40 formed in the side surface of the main tank unit 29. When the pressurizing pump 38 is driven, air is pushed into the ink absorption members 30 within the main tank unit 29 through the pressurizing tube 39. In other words, in this embodiment, the recess 37 of the ink absorption member 30 functions as a pressurizing action portion that causes a pressurizing force to act on the ink absorption members 30. The pressurizing pump 38 and the pressurizing tube 39 correspond to a pressurizing unit, whereas the through-hole 40 corresponds to a connection portion that connects the pressurizing unit to the main tank unit 29. Furthermore, in this embodiment, the recess 33 and the recess 37 are formed in the respective side surfaces of the ink absorption member 30 in the horizontal direction, at the same height in the vertical direction. A pressurizing force acts on the ink absorption members 30 so as to disperse the waste ink in the horizontal direction that is the same direction as the direction in which the waste ink is dispersed from the recess 37. At this time, the ink that has been discharged from the discharge tube 26 into the ink absorption members 30 is dispersed under the force of gravity, the osmotic force of the ink absorption members 30, the suction force from the depressurizing tube 35, and the pressurizing force from the pressurizing tube 39. In addition, the recess 31 and the recess 37 are formed in the same side positions in their corresponding ink absorption members 30, in positions that are adjacent to each other in the vertical direction.

Meanwhile, a slight amount of clearance is provided between the leading end of the depressurizing tube 35 and the inner surface of the recess 33. Accordingly, even if the depressurizing pump 34 applies suction to the ink absorption members 30 through the depressurizing tube 35, the waste ink will not be sucked into the depressurizing pump 34 through the depressurizing tube 35.

Next, effects of the printer 11 configured as described above will be explained, with a particular focus placed on effects occurring when the waste ink discharged into the waste ink tank 28 is dispersed throughout the entirety of the ink absorption members 30. Note that the discharge tube 26, the recess 31, the depressurizing tube 35, the recess 33, the pressurizing tube 39, and the recess 37 will not be discussed in the explanations of the effects.

Figure 3A:
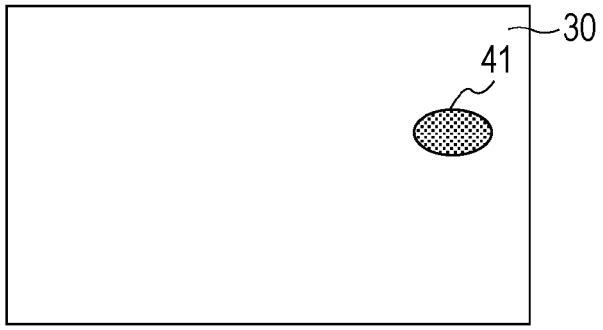
FIG. 3A is a schematic diagram illustrating a state immediately after an ink absorption member has received waste ink.

When the maintenance unit 24 executes a maintenance operation on the recording head 21, the waste ink is discharged from the cap 25 and through the discharge tube 26, into an area of the ink absorption members 30 that is toward the upper-right shown in FIG. 3A. Upon doing so, the waste ink discharged into the ink absorption members 30 is dispersed and absorbed throughout the inner surface of the recess 31 in the ink absorption member 30 due to the effects of capillarity from the ink absorption members 30; as a result, a waste ink receiving area 41 is formed. Note that in this embodiment, the waste ink receiving area 41 in the ink absorption members 30 refers to an area of the ink absorption members 30 that has received the waste ink, for example, approximately 30 seconds after the waste ink has begun to disperse throughout the ink absorption members 30 from the discharge tube 26. As shown in FIG. 2A, the receiving area 41 is located below the recess 33. The recess 37, meanwhile, is provided in a position that is closer to the receiving area 41 than the recess 33.

Figure 3B:
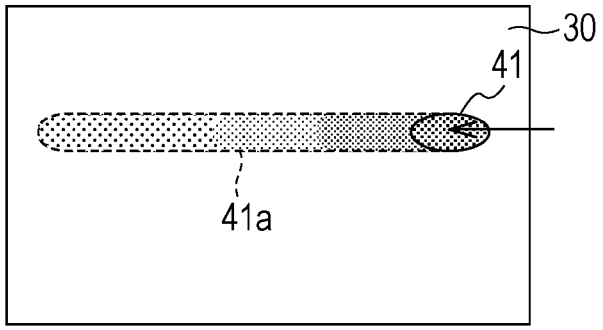
FIG. 3B is a schematic diagram illustrating a state in which the waste ink has dispersed in the horizontal direction from the state illustrated in FIG. 3A.

Here, in the case where the depressurizing pump 34 is not driven, the waste ink contained in this receiving area 41 disperses in the horizontal direction, as indicated by the dotted line in FIG. 3B. Although FIG. 3B illustrates an area in which the waste ink has dispersed in the horizontal direction, it should be noted that this is simply to make the diagram easier to understand. In reality, the waste ink disperses downward as well, in addition to the horizontal direction. Furthermore, although FIG. 3B illustrates an area in which the waste ink does not disperse to the left and right, in reality, the waste ink receiving area 41 in the ink absorption members 30 disperses the waste ink so as to extend horizontally in a long, thin area across essentially the entirety of the ink absorption members 30 in the horizontal direction. This dispersion takes place gradually, from several hours to several days. In this case, a slope in which the amount of waste ink gradually decreases from the right side to the left side is formed in an area 41*a* in which the waste ink has dispersed throughout the ink absorption members 30.

Figure 3C:
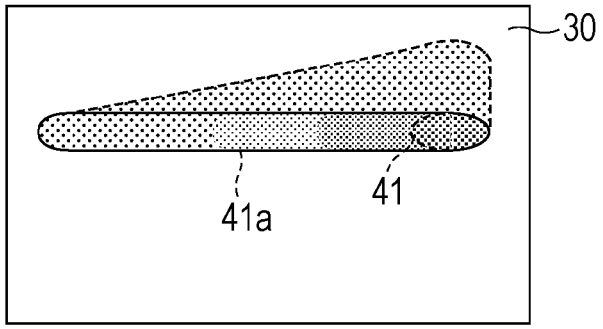
FIG. 3C is a schematic diagram illustrating a state in which the waste ink has dispersed upward from the state illustrated in FIG. 3B.

Incidentally, although a greater amount of waste ink permeates downward and in the horizontal direction, some waste ink also permeates upward. Here, the waste ink naturally permeates upward with more ease in areas in which the amount of waste ink is relatively greater. However, the waste ink naturally permeates upward with more difficulty in areas in which the amount of waste ink is relatively lower. As a result, in the ink absorption members 30, the waste ink sufficiently permeates into the upper-right end in the vicinity of the receiving area 41 shown in FIG. 3C, but almost no waste ink permeates into the upper-left end shown in FIG. 3C, which is an area that is distanced from the receiving area 41 both in the horizontal direction and the vertical direction. In other words, as indicated by the dotted line in FIG. 3C, in the area toward the upper end of the ink absorption members 30, the waste ink is dispersed upward so as to result in a slope that progresses downward the farther the distance is from the receiving area 41.

Figure 3D:
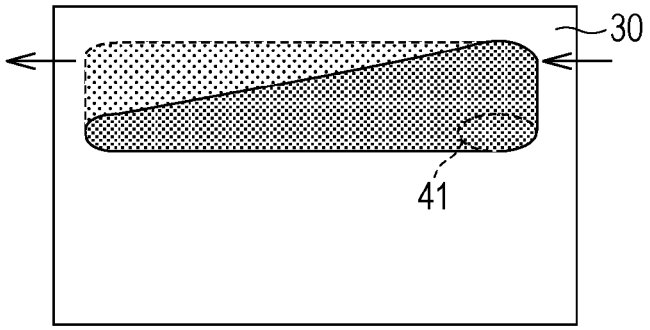
FIG. 3D is a schematic diagram illustrating a state in which the waste ink has dispersed in the horizontal direction from the state illustrated in FIG. 3C.

Next, when, in this state, the depressurizing pump 34 is driven, a suction force acts horizontally on the upper-left end of the ink absorption members 30, as shown in FIG. 3D. Then, the suction force acting on the ink absorption members 30 also acts on the waste ink contained in the ink absorption members 30. Accordingly, as indicated by the dotted line shown in FIG. 3D, the waste ink disperses throughout the ink absorption members 30, from the receiving area 41 toward the left end. Particularly, in this embodiment, the recess 33 is provided above the receiving area 41, and thus the depressurizing pump 34 prompts the waste ink to disperse upward.

Furthermore, in this embodiment, the pressurizing pump 38 is driven after the depressurizing pump 34 has been driven. Accordingly, a pressurizing force acts horizontally on the upper-right end of the ink absorption members 30, as shown in FIG. 3D. The waste ink that has permeated into the area toward the upper end of the ink absorption members 30 then disperses in the horizontal direction, from the side on which the recess 37 is provided toward the side on which the recess 33 is provided. Here, the suction force from the depressurizing pump 34 acts significantly on the waste ink that has permeated into the upper-left end shown in FIG. 3D, which is an area that is distanced from the receiving area 41. On the other hand, the suction force from the depressurizing pump 34 does not act significantly on the waste ink that has permeated into the upper-right end shown in FIG. 3D, which is an area that is in the vicinity of the receiving area 41. However, the pressurizing force from the pressurizing pump 38 acts on the waste ink that has permeated into the area in the vicinity of the receiving area 41, in a direction that extends from the receiving area 41 toward the recess 33. Accordingly, the pressurizing pump 38 assists the depressurizing pump 34 in dispersing the waste ink throughout the entirety of the horizontal direction in the area toward the upper end of the ink absorption members 30. Note that the "direction that extends from the receiving area 41 toward the recess 33" refers not only to the direction that extends in a linear manner from the receiving area 41 toward the recess 33, but refers to all directions extending toward positions in which the distance from the receiving area 41 to the recess 33 decreases.

According to the first embodiment described thus far, the following effects can be achieved.

1. When the pressurizing force acts on the recess 37 in the ink absorption members 30, the depressurizing pump 34 is assisted in dispersing the waste ink in the receiving area 41. Accordingly, the area of the ink absorption members 30 throughout which the waste ink permeates and disperses is enlarged, and thus the ink absorption members 30 can sufficiently absorb the waste ink.

2. A strong pressurizing force acts on the waste ink that is far from the recess 33 and thus upon which the suction force acts with difficulty, whereas a weak pressurizing force acts upon the waste ink that is near the recess 33 and thus upon which the suction force acts with ease; accordingly, the waste ink can be caused to permeate throughout the entirety of the ink absorption members 30.

3. The pressurizing pump 38 exerts a pressurizing force in the horizontal direction on the waste ink that has been received in the receiving area 41, and therefore the waste ink disperses throughout the ink absorption members 30 in the horizontal direction. In this case, the suction force acting on the ink absorption members 30 in the horizontal direction from the recess 33 of the ink absorption member 30 assists the dispersal of the waste ink in the horizontal direction. Accordingly, the area of the ink absorption members 30 throughout which the waste ink permeates and disperses is enlarged, and thus the ink absorption members 30 can sufficiently absorb the waste ink.

The aforementioned first embodiment may be altered to variations such as those described hereinafter.

Figure 4:
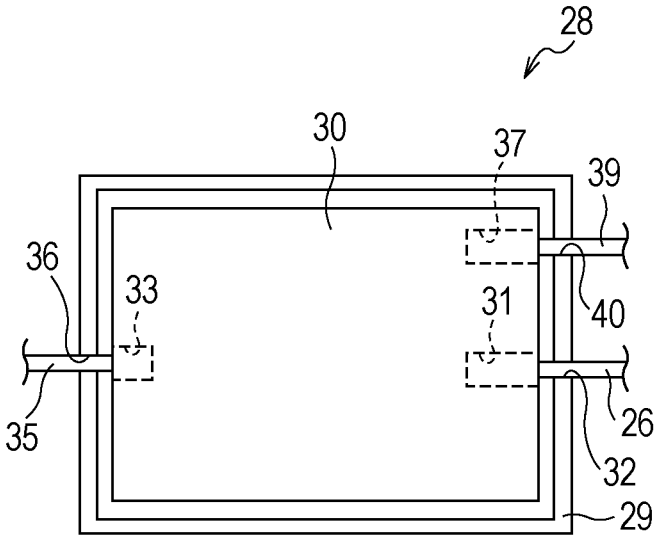
FIG. 4 is a schematic diagram illustrating a variation on the maintenance unit according to the first embodiment.

In the aforementioned first embodiment, the recess 31 and the recess 33 may be provided so as to oppose each other in the lengthwise direction of the ink absorption member 30 when viewed from above, as shown in FIG. 4.

In the aforementioned first embodiment, the vertical position of the recess 33 and the vertical position of the recess 37 in the ink absorption member 30 may be shifted from each other.

In the aforementioned first embodiment, the recess 31 may be formed in the side surface of the ink absorption member 30 that, of the stacked ink absorption members 30, is in the uppermost position. In this case, the recess 31 and the recess 37 may be formed at the same height, by disposing those recesses so as to be shifted from each other in the plane.

In the aforementioned first embodiment, the recess 31 may be formed in the side surface of an ink absorption member 30 that is lower than the middle of the vertical direction of the stacked ink absorption members 30.

Second Embodiment

Next, a second embodiment of the invention will be described with reference to FIG. 5A to FIG. 6D. Note that in the second embodiment, the state of the connections between the main tank unit 29 and the discharge tube 26, depressurizing tube 35, and pressurizing tube 39 differs from that described in the first embodiment. Accordingly, the following descriptions will focus primarily on the configurations that differ from the first embodiment; elements that are the same as or correspond to those in the first embodiment will be given the same reference numerals, and duplicate descriptions thereof will be omitted.

Figure 5A:
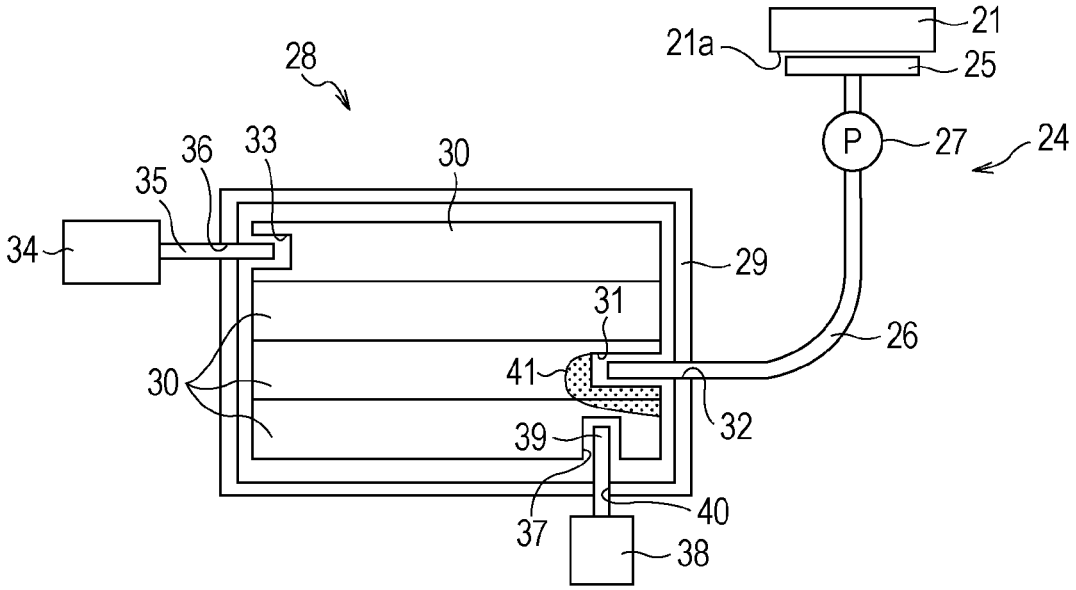
FIG. 5A is a schematic diagram illustrating a maintenance unit according to a second embodiment seen from the front.
Figure 5B:
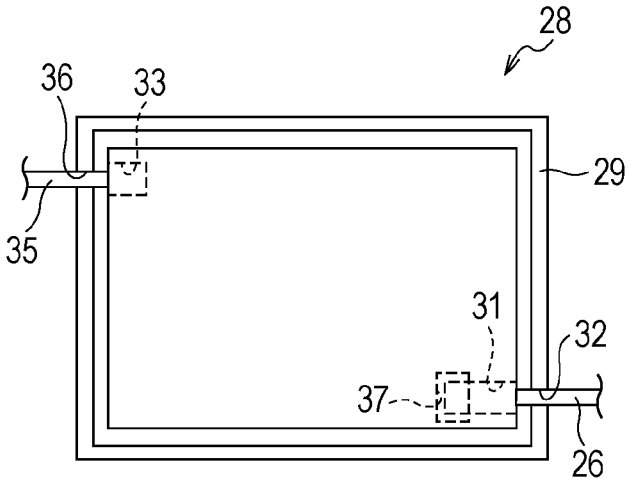
FIG. 5B is a schematic diagram illustrating the maintenance unit according to the second embodiment seen from above.

As shown in FIGS. 5A and 5B, in this embodiment, of the plurality of (four, in this embodiment) ink absorption members 30 housed within the substantially box-like shaped main tank unit 29, the recess 31 is formed in the side surface of the ink absorption member 30 that is positioned third from the top. The leading end of the discharge tube 26 is inserted into the recess 31 of the ink absorption member 30 via the through-hole 32 formed in the side surface of the main tank unit 29. On the other hand, of the plurality of ink absorption members 30 housed within the main tank unit 29, the recess 37 is formed in the side surface of the ink absorption member 30 that is in the lowermost position. The leading end of the pressurizing tube 39 is inserted into the recess 37 of the ink absorption member 30 via the through-hole 40 formed in the bottom surface of the main tank unit 29. Furthermore, of the plurality of ink absorption members 30 housed within the main tank unit 29, the recess 33 is formed in the side surface of the ink absorption member 30 that is in the uppermost position. The leading end of the depressurizing tube 35 is inserted into the recess 33 of the ink absorption member 30 via the through-hole 36 formed in the side surface of the main tank unit 29. In other words, in this embodiment, the recess 33 is positioned in a higher position than the recess 37.

Figure 6A:
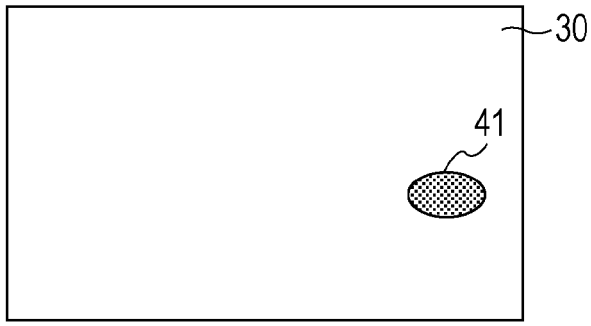
FIG. 6A is a schematic diagram illustrating a state immediately after an ink absorption member has received waste ink.

When the maintenance unit 24 executes a maintenance operation on the recording head 21, the waste ink is discharged from the cap 25 and through the discharge tube 26, into an area of the ink absorption members 30 that is toward the lower-right shown in FIG. 6A. Upon doing so, the waste ink discharged into the ink absorption members 30 is dispersed and absorbed throughout the ink absorption members 30 due to the effects of capillarity from the ink absorption members 30; as a result, the waste ink receiving area 41 is formed. As shown in FIG. 5A, the receiving area 41 is positioned below the recess 33. The recess 37, meanwhile, is provided in a position that is closer to the receiving area 41 than the recess 33.

Figure 6B:
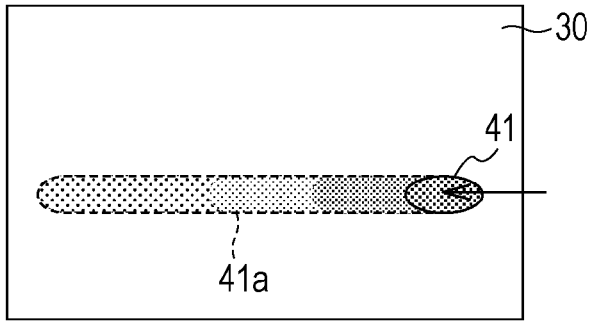
FIG. 6B is a schematic diagram illustrating a state in which the waste ink has dispersed in the horizontal direction from the state illustrated in FIG. 6A.

Here, in the case where the depressurizing pump 34 is not driven, the waste ink contained in this receiving area 41 disperses throughout the ink absorption members 30 in the horizontal direction, as indicated by the dotted line in FIG. 6B. Although FIG. 6B illustrates an area in which the waste ink has dispersed in the horizontal direction, it should be noted that this is simply to make the diagram easier to understand. In reality, the waste ink disperses downward as well, in addition to the horizontal direction. Furthermore, although FIG. 6B illustrates an area in which the waste ink does not disperse to the left and right, in reality, the waste ink receiving area 41 in the ink absorption members 30 disperses the waste ink so as to extend horizontally in a long, thin area across essentially the entirety of the ink absorption members 30 in the horizontal direction. In this case, a slope in which the amount of waste ink gradually decreases from the right side to the left side in FIG. 6B is formed in the area 41*a* in which the waste ink has dispersed throughout the ink absorption members 30.

Figure 6C:
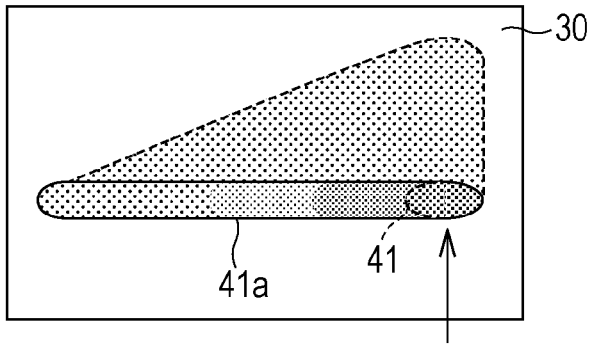
FIG. 6C is a schematic diagram illustrating a state in which the waste ink has dispersed upward from the state illustrated in FIG. 6B.

Next, the pressurizing pump 38 is driven, in a state in which the waste ink has dispersed throughout the ink absorption members 30 in the horizontal direction. Accordingly, a pressurizing force acts on the ink absorption members 30, in the lower-right end of the ink absorption members 30, as shown in FIG. 6C. The pressurizing force acting on the ink absorption members 30 also acts on the waste ink contained in the ink absorption members 30. Accordingly, the waste ink indicated by the solid line disperses upward throughout the ink absorption members 30, as indicated by the dotted line in FIG. 6C.

Here, within the area 41*a* of the ink absorption members 30 throughout which the waste ink is dispersed, in the area that is located relatively close to the receiving area 41, the waste ink is significantly dispersed upward throughout the ink absorption members 30 when the pressurizing pump 38 is driven. On the other hand, within the area 41*a* of the ink absorption members 30 throughout which the waste ink is dispersed, the pressurizing force when the pressurizing pump 38 is driven does not significantly act on the area that is located relatively far from the receiving area 41. Accordingly, as indicated by the dotted line in FIG. 6C, in the area toward the upper end of the ink absorption members 30, the waste ink is dispersed upward against the force of gravity so as to result in a slope that progresses downward the farther the distance is from the receiving area 41.

Figure 6D:
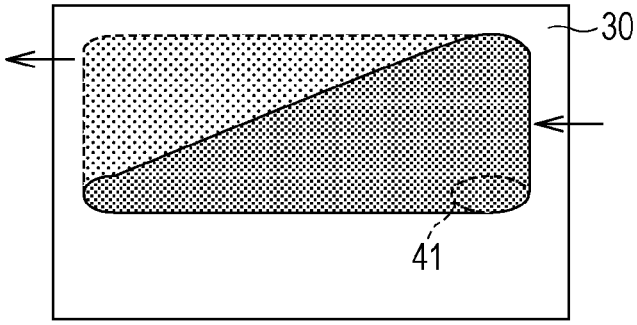
FIG. 6D is a schematic diagram illustrating a state in which the waste ink has dispersed in the horizontal direction from the state illustrated in FIG. 6C.

Next, when, in this state, the depressurizing pump 34 is driven, a suction force acts in the horizontal direction on the upper-left end of the ink absorption members 30, as shown in FIG. 6D. Then, the suction force acting on the ink absorption members 30 also acts on the waste ink contained in the ink absorption members 30. Accordingly, the waste ink indicated by the solid line is dispersed throughout the ink absorption members 30 in the horizontal direction, away from the receiving area 41, as indicated by the dotted line in FIG. 6D.

Here, the waste ink is dispersed so that the area toward the upper end of the ink absorption members 30, in which the suction force from the depressurizing pump 34 acts, results in a slope that progresses downward the farther the distance is from the receiving area 41. Accordingly, when the waste ink disperses throughout the ink absorption members 30 in the horizontal direction toward the recess 33, the waste ink disperses across approximately the entirety of the horizontal direction in the area toward the upper end of the ink absorption members 30. As a result, the ink absorption members 30 absorb the waste ink over a wide range. Accordingly, the ink absorption members 30 can hold the waste ink in an efficient manner.

Therefore, according to this embodiment, the following effects can be achieved in addition to the aforementioned first and second effects of the first embodiment.

4. When the pressurizing force acts from the recess 37 of the ink absorption member 30 from vertically below the receiving area 41, the waste ink received in the receiving area 41 disperses upward. Then, when the suction force acts on this dispersed waste ink in the horizontal direction from the recess 33 of the ink absorption member 30, the waste ink disperses in the horizontal direction. Accordingly, the area of the ink absorption members 30 throughout which the waste ink permeates and disperses is enlarged, and thus the ink absorption members 30 can sufficiently absorb the waste ink.

5. When the pressurizing force from the pressurizing pump 38 acts on the recess 37 of the ink absorption members 30 from vertically below the receiving area 41, the waste ink disperses upward from the receiving area 41. When the suction force acts on this dispersed ink in the horizontal direction from the recess 33 of the ink absorption member 30, the area of the ink absorption members 30 throughout which the ink permeates and disperses is enlarged across a wide range between the recess 37 and the recess 33. Accordingly, the ink absorption members 30 can sufficiently absorb the waste ink.

The aforementioned second embodiment may be altered to variations such as those described hereinafter.

Figure 7:
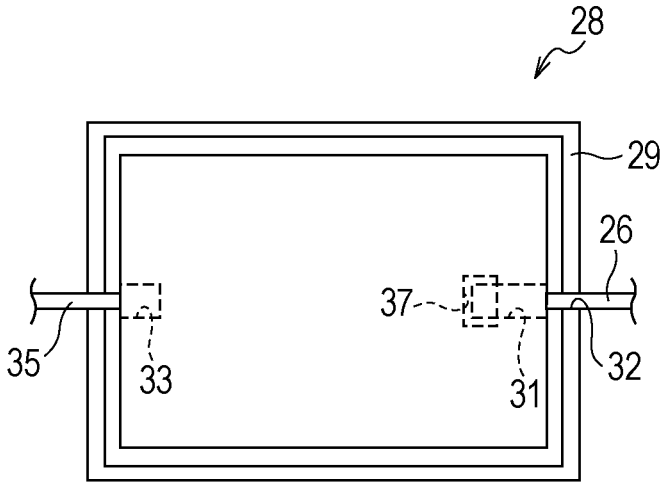
FIG. 7 is a schematic diagram illustrating a variation on the maintenance unit according to the second embodiment.

In the aforementioned second embodiment, the recess 31 and the recess 33 may be provided so as to oppose each other in the lengthwise direction of the ink absorption member 30 when viewed from above, as shown in FIG. 7.

In the aforementioned second embodiment, the pressurizing tube 39 may be inserted into an area that is in approximately the center of the bottom surface of the main tank unit 29. It is desirable for the pressurizing tube 39 to be to the right of the center in the bottom surface of the main tank unit 29 in FIG. 5A.

In the aforementioned second embodiment, the pressurizing tube 39 may be inserted into the side surface of the main tank unit 29, and the pressurizing force from the pressurizing pump 38 may then be caused to act from vertically above the receiving area 41.

In the aforementioned second embodiment, the depressurizing tube 35 may be configured so as to extend into the ink absorption members 30 in a direction that is orthogonal to the horizontal direction.

The aforementioned embodiments may be altered to other embodiments as described hereinafter as well.

In the aforementioned embodiments, the pressurizing operations of the pressurizing pump 38 and the depressurizing operations of the depressurizing pump 34 may be started simultaneously. Likewise, the pressurizing pump 38 may be driven while the waste ink is being caused to disperse throughout the ink absorption members 30, or may be driven immediately after the waste ink has been discharged to the ink absorption members 30.

In the aforementioned embodiments, the pressurizing pump 38 may pressure and supply air that has been sucked from the main tank unit 29 through the depressurizing tube 35 to the main tank unit 29 as pressure. In this case, the pressurizing pump 38 can also function as a depressurizing pump.

In the aforementioned embodiments, the recess 33 may be formed in the side surface of an ink absorption member 30, of the stacked ink absorption members 30, aside from the ink absorption member 30 that is in the uppermost position.

Figure 8:
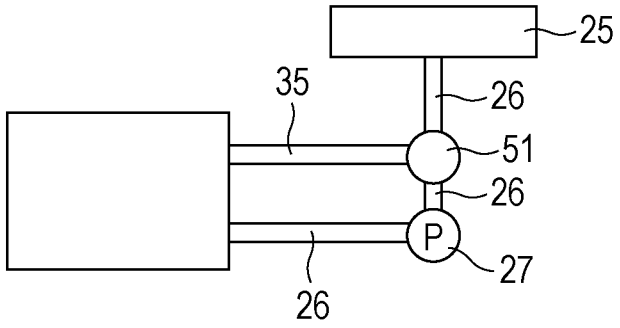
FIG. 8 is a schematic diagram illustrating another embodiment of a maintenance unit.

As shown in FIG. 8, in the aforementioned embodiments, a switching valve 51 may be provided in a position that is partway through the discharge tube 26 that connects the cap 25 to the suction pump 27, and the depressurizing tube 35 may then be connected to this switching valve 51. In this case, the suction pump 27 can also function as the depressurizing pump 34 by using the switching valve 51 to switch the suction pump 27 between communicating with the cap 25 and communicating with the depressurizing tube 35. In addition, the suction pump 27 may pressure and supply air that has been sucked from the main tank unit 29 through the depressurizing tube 35 to the main tank unit 29. In this case, the suction pump 27 can also function as a pressurizing pump and a depressurizing pump.

In the aforementioned embodiments, a liquid ejecting apparatus that ejects and discharges a liquid aside from ink may be employed as the liquid ejecting apparatus. The invention can also be applied in various types of liquid-consuming apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid-consuming apparatus. For example, any matter can be used as long as the matter is in its liquid state, including liquids having high or low viscosity, sol, gel water, other inorganic agents, organic agents, liquid solutions, liquid resins, and fluid states such as liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, can also be given as an example. Here, "ink" generally includes water-based and oil-based inks, as well as various types of fluid compositions, including gel inks, hot-melt inks, and so on. The following are specific examples of such liquid-consuming apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, front emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching.

The entire disclosure of Japanese Patent Application Nos. 2010-210514, filed Sep. 21, 2010, 2011-136009, filed Jun. 20, 2011 are expressly incorporated by reference herein.

What is claimed is:

1. A liquid collection receptacle capable of collecting a discharged liquid, the liquid collection receptacle comprising:

a liquid absorption member including a receiving area that receives the discharged liquid and causes the liquid to be absorbed;

a suction action portion, arranged at a location spaced apart from the receiving area and separated from the receiving area by the liquid absorption member, the suction action portion receiving a suction unit that extends into the suction action portion with a clearance between the portion of the suction unit and the liquid absorption member forming the suction action to thereby cause a suction force to act within the liquid absorption member to move the discharge liquid toward the suction action portion; and a pressurizing action portion, disposed in a position that is closer to the receiving area than the suction action portion, the pressurizing action portion receiving a pressurizing unit that extends into the pressurizing action portion to thereby cause a pressurizing force to act within the liquid absorption member to move the discharge liquid away from the receiving area, the pressurizing action portion being arranged at another location spaced apart from the suction action portion and arranged between a top portion of the liquid absorption member and the receiving area in the vertical direction, wherein the suction action portion comprises a first recess that is defined by the liquid absorption member, and wherein the pressurizing action portion comprises a second recess that is defined by the liquid absorption member and separated from the receiving area by another portion of the liquid absorption member.

2. The liquid collection receptacle according to claim 1, wherein the pressurizing force assists the liquid in permeating in a direction toward the suction action portion.

3. The liquid collection receptacle according to claim 1, wherein the suction action portion and the pressurizing action portion are provided in positions that are distanced from each other in the horizontal direction of the liquid absorption member.

4. The liquid collection receptacle according to claim 1, wherein the height of the suction action portion in the vertical direction is greater than or equal to the height of the pressurizing action portion in the vertical direction.

5. The liquid collection receptacle according to claim 1, wherein the suction action portion and the pressurizing action portion are provided in respective side surfaces on both sides in the horizontal direction of the liquid absorption member.

6. The liquid collection receptacle according to claim 1, wherein the pressurizing action portion causes the pressurizing force to act from below the receiving area; and the suction action portion causes the suction force to act in the horizontal direction relative to the receiving area, at a position that is higher than the pressurizing action portion.

7. The liquid collection receptacle according to claim 6, wherein the pressurizing action portion causes the pressurizing force to act on the receiving area in an area that is toward the opposite side as the suction action portion.

8. The liquid collection receptacle according to claim 1, wherein the receiving area extends inwardly from a side surface of the liquid absorption member and terminating within the liquid absorption member.

9. A liquid ejecting apparatus comprising:

a liquid ejecting head that ejects a liquid onto a target;

a liquid collection receptacle comprising:

a liquid absorption member including a receiving area that receives the discharged liquid and causes the liquid to be absorbed;

a suction action portion, arranged at a location spaced apart from the receiving area and separated from the receiving area by the liquid absorption member, the suction action portion being configured to cause a suction force to act within the liquid absorption member to move the discharge liquid toward the suction action portion; and a pressurizing action portion, disposed in a position that is closer to the receiving area than the suction action portion, the pressurizing action portion being configured to cause a pressurizing force to act within the liquid absorption member to move the discharge liquid away from the receiving area, the pressurizing action portion being arranged at another location spaced apart from the suction action portion and arranged between a top portion of the liquid absorption member and the receiving area in the vertical direction;

a discharge unit that sucks the liquid from the liquid ejecting head and discharges the liquid to the liquid collection receptacle; a suction unit that exerts a suction force on the liquid collection receptacle, a portion of the suction unit extending into the suction action portion with a clearance between the portion of the suction unit and the liquid absorption member forming the suction action portion; and a pressurizing unit that exerts a pressurizing force on the liquid collection receptacle by pushing an air, a portion of the pressurizing unit extending into the pressurizing action portion.

10. The liquid collection receptacle according to claim 9, wherein the pressurizing unit is driven after the suction unit has been driven.

* * * * *